US005299624A

United States Patent [19]

McKinney, Sr.

[11] Patent Number: 5,299,624

[45] Date of Patent: Apr. 5, 1994

[54] FLUID ASSISTED CASTING APPARATUS

[75] Inventor: Larry G. McKinney, Sr., Brownwood, Tex.

[73] Assignee: Kohler Co., Kohler, Wis.

[21] Appl. No.: 68,805

[22] Filed: May 27, 1993

Related U.S. Application Data

[63] Continuation of Ser. No. 926,248, Aug. 6, 1992, abandoned.

[51] Int. Cl.[5] ..... B22D 17/22; B22D 29/00

[52] U.S. Cl. ..... 164/344; 264/335

[58] Field of Search ..... 164/131, 344; 264/335

[56] References Cited

U.S. PATENT DOCUMENTS

| | | | |
|---|---|---|---|
| 961,214 | 6/1910 | Crane | 264/335 |
| 1,244,257 | 10/1917 | Sweetnam | 154/DIG. 4 |
| 2,090,528 | 8/1937 | Ferngren | 264/335 |
| 2,584,109 | 2/1952 | Blackburn et al. | 264/335 |
| 2,629,135 | 2/1953 | Johnson | 263/335 |
| 2,632,227 | 3/1953 | Steele et al. | 264/335 |
| 2,669,762 | 2/1954 | Blackburn et al. | 264/335 |
| 3,570,064 | 3/1971 | De Groot . | |
| 3,570,068 | 3/1972 | Ruggles et al. . | |
| 3,663,681 | 5/1972 | Ehrlich | 264/335 |
| 3,825,378 | 7/1974 | Dart et al. | 264/335 |
| 4,179,254 | 12/1979 | Brown | 425/438 |
| 4,296,908 | 10/1981 | Lippa | 249/58 |
| 4,931,007 | 6/1990 | Gold/dalg et al. | 425/438 |

FOREIGN PATENT DOCUMENTS

| | | | |
|---|---|---|---|
| 0075814 | 6/1981 | Japan | 264/335 |
| 3162213 | 7/1988 | Japan | 264/335 |

*Primary Examiner*—Paula A. Bradley
*Assistant Examiner*—Erik R. Puknys
*Attorney, Agent, or Firm*—Quarles & Brady

[57] ABSTRACT

An apparatus and method for automated casting of an item such as a plumbing fixture is disclosed. Female and male mold portions provide a spacing for molding the desired item between them. A fluid release system is operatively positioned inside one of the mold portions so as to assist in separating the formed item from a mold portion in a controlled and uniform manner so as to minimize damage to the cast item. In a preferred form, a liquid is ejected into the corners of a male mold. By diffusion the liquid travels to the periphery of the mold piece so as to drive the formed part off the mold.

14 Claims, 4 Drawing Sheets

FLUID ASSISTED CASTING APPARATUS

This application is a continuation of application Ser. No. 07/926,248, filed Aug. 6, 1991 and now abandoned.

BACKGROUND OF THE INVENTION

A. Field Of The Invention

This invention relates to an apparatus and method for automating the process of casting articles. It appears to be especially well suited for use in automating the removal of a plurality of castings in the form of plumbing fixtures.

B. Description Of The Art

It is known in the art to utilize a manually drivable "stripper" ring to assist in separating a molded part from a mold member. This is shown in U.S. Pat. No. 4,296,908. The art has also provided an inflatable hose as a driving means to drive a stripper ring for releasing molded parts (U.S. Pat. No. 4,931,007). However, further improvement is desired in automating the casting process, especially with respect to plumbing fixtures and the like where extremely fragile castings must be removed from the mold.

In this regard, manually drivable stripper rings are time consuming to use, and may damage the contact surface of the molded product. They do not provide sufficient control over the amount of pressure the fragile casting edges are exposed to. Existing systems are also deficient in the areas of automating the process of separating the mold halves. If not properly done, the fragile molded part can, on occasion, be damaged during this process (aside from the excessive time required to undo multiple manual clamps and to manually separate mold halves.

Other existing systems require the use of extra costly components such as stripper rings and inflatable hoses. Thus, an improved molding apparatus and method are needed.

SUMMARY OF THE INVENTION

The present invention relates to machines and methods for casting desired items in molds, and to improved means of separating the casted piece from the mold parts. In a preferred embodiment, there is an apparatus which includes a female mold portion and a male mold portion for spaced positioning in the female mold portion such that a desired item can be formed therebetween. A release means in the form of a fluid driving means is operatively associated with one of the mold portions to force fluid through the mold portion and against the casted piece. This assists in separating the formed item from the mold portion.

In a preferred embodiment, the fluid driving means is provided by a multiplicity of channel members disposed in the male mold portions.

In another embodiment, there are holding means including inflatable fluid means for clamping the mold portions together, and yet another inflatable means positioned between the mold portions for separating them.

In still another embodiment, there is provided a method of casting a desired item. One introduces a casting material between first and second mold portions; casts the desired item between said first and second mold portion; separates the mold portions; and their separates the cast desired item from one of the mold portions by introducing a fluid into the mold portion with the cast item attached.

The apparatus and method of the invention further improve the automation of multiple casting of items (e.g. ceramic toilet tanks).

The objects of the invention include:

providing an automated method and apparatus for removing a fragile cast part from a mold member with reduced risk of damaging the part;

providing a method and apparatus for the multiple casting of ceramic materials which lends itself to a high production mode;

providing a method and apparatus where a cast part can be separated from a mold part in a simplified manner and with few parts; and providing a highly efficient method and process of the above kind for producing cast materials. These and other objects and advantages of the present invention will be apparent from the description which follows. This description below is provided by way of illustrating preferred embodiments of the present invention, not to limit the claim scope. Thus, the claims are not to be limited to just the embodiments shown.

DESCRIPTION OF THE DRAWINGS

A better understanding of the invention will be had with reference to the accompanying drawings wherein.

DESCRIPTION OF THE PREFERRED EMBODIMENTS

Figure 1:
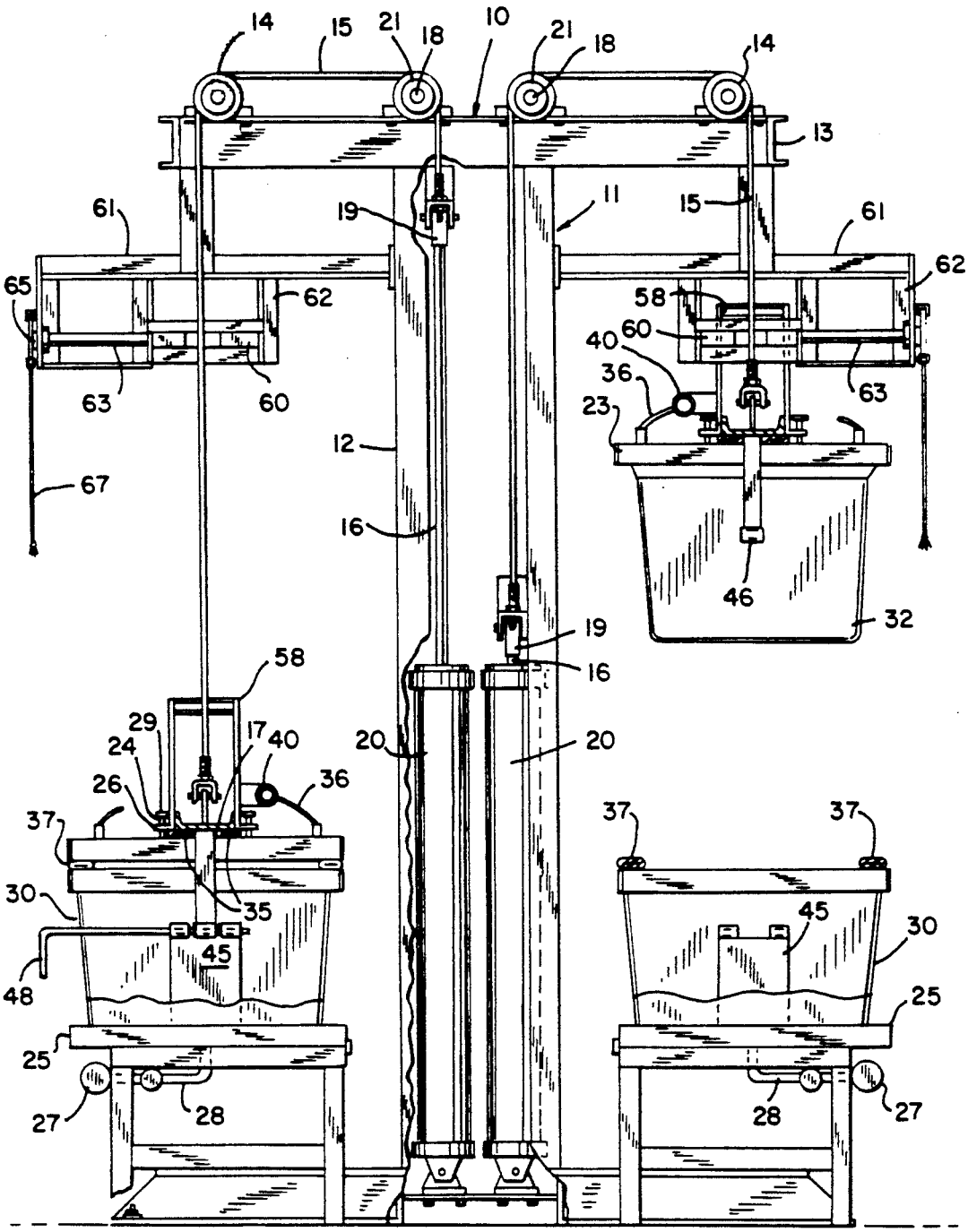
FIG. 1 is an end elevational view showing the apparatus of this invention in two different stages of operation.
Figure 2:
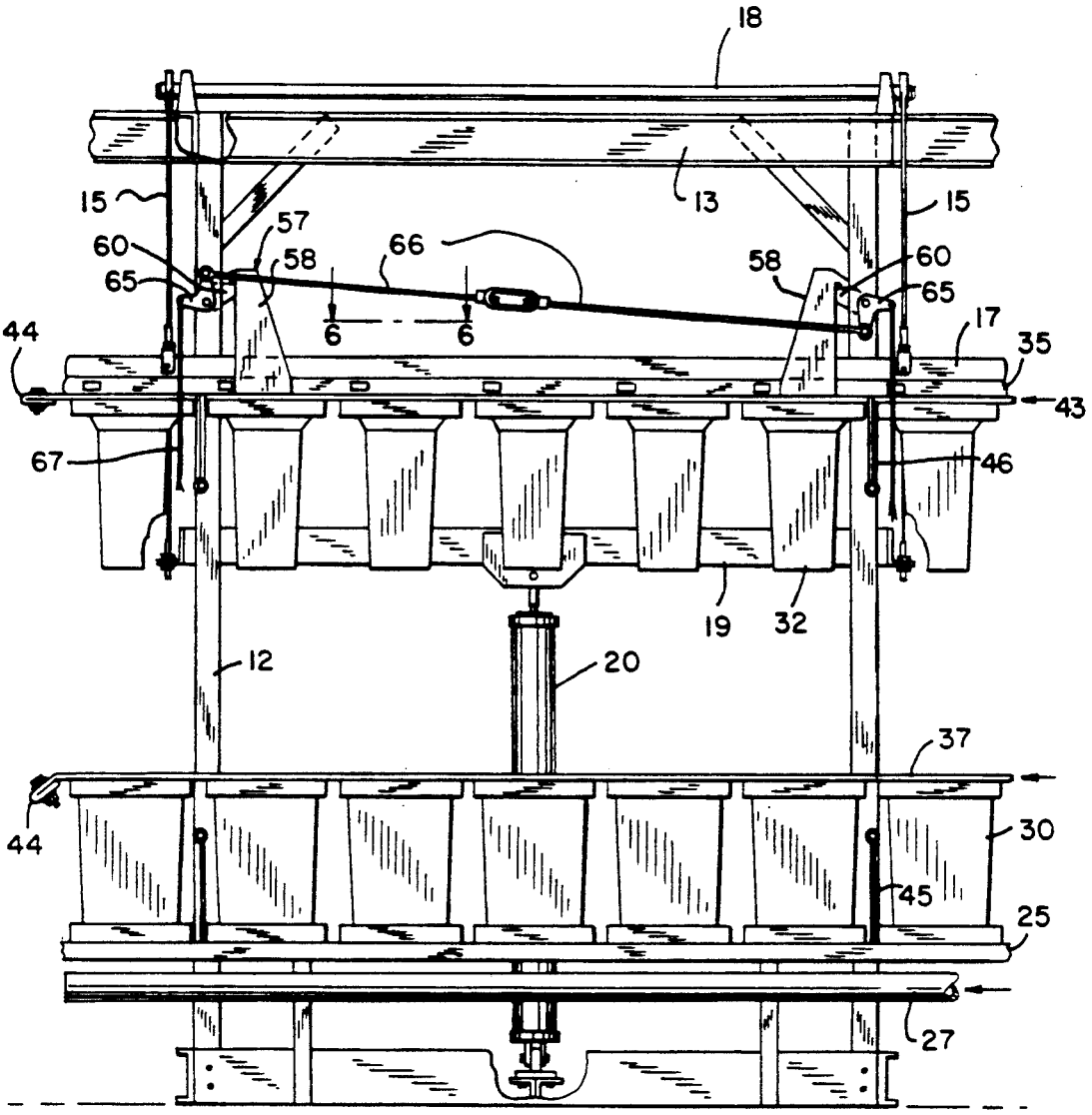
FIG. 2 is a front elevational view of the apparatus shown in FIG. 1.
Figure 6:
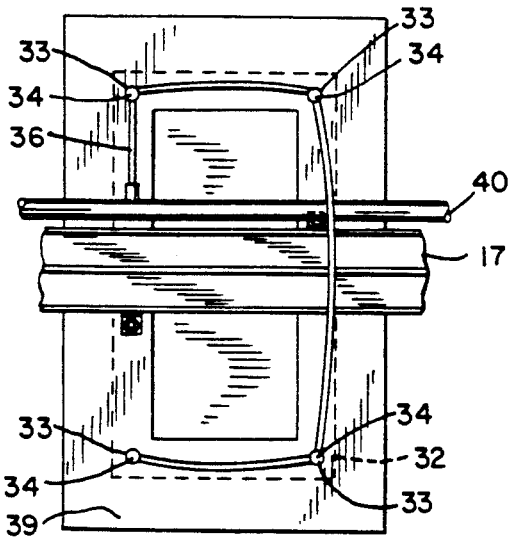
FIG. 6 is a top plan view of a mold part taken along line 6—6 of FIG. 2, illustrating the distribution of air to the mold part.

The overall casting apparatus (generally 10) is best seen in FIGS. 1 and 2. It includes a frame assembly (generally 11) that runs from end to end, hydraulic cylinders 20 for raising and lowering the upper portion 23 of the production line. The frame assembly 11 includes vertical 12 and horizontal 13 cross supports with the horizontal supports 13 providing rotatable support for the chain guide sprockets 14 and 21 rotatably mounted on shafts 18. A chain 15 engages the sprockets 14 and 21 and is connected at one end to an end of end beam 17, and at the other end to the cylinder rods 16 of the cylinders 20. This latter connection is provided through the beam 19 as best seen in FIG. 2. These cylinders 20 through the previously described connection with the chain 15 will raise and lower the upper portions 23.

Figure 3:
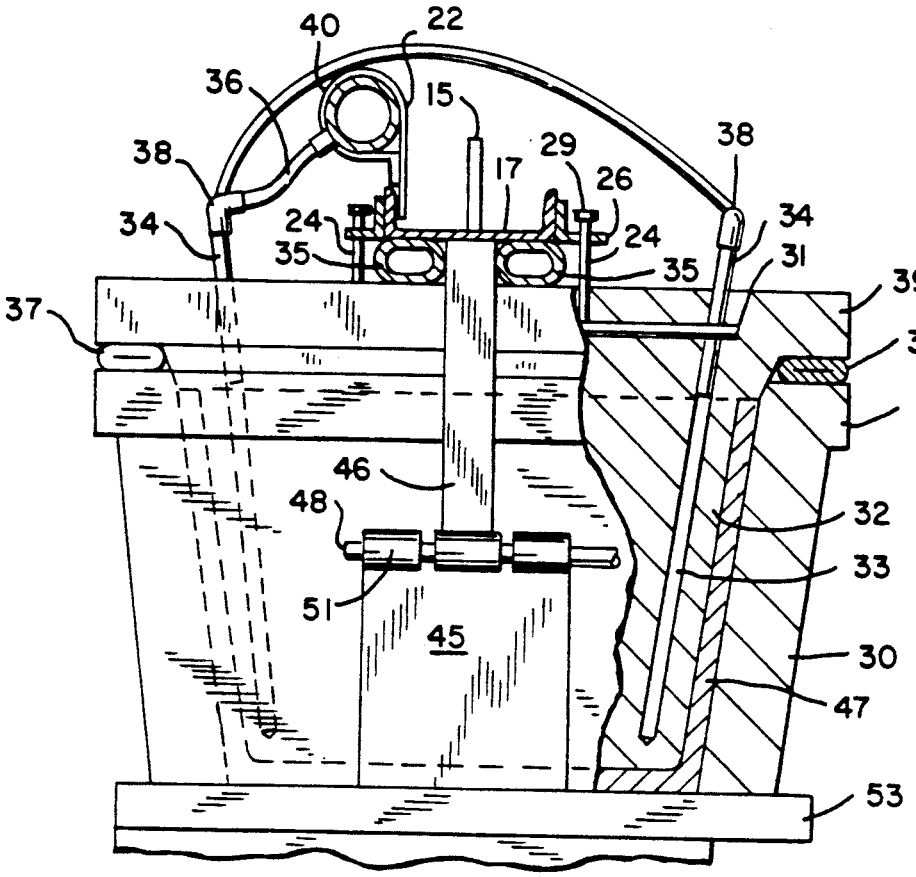
FIG. 3 is an enlarged detailed view of a portion of the left hand side of FIG. 1, with a portion broken away, illustrating the mold parts in a clamped position, in the casting mode.
Figure 4:
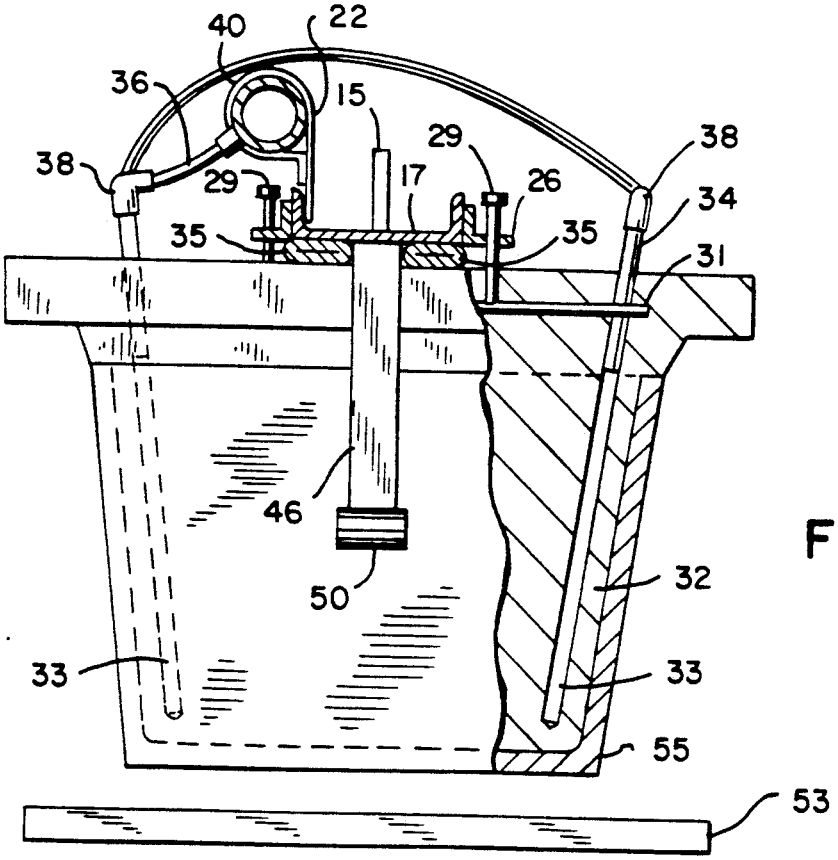
FIG. 4 is a view similar to FIG. 3, but showing the molding apparatus in a final stage of operation and prior to the release of the molded part.
Figure 5:
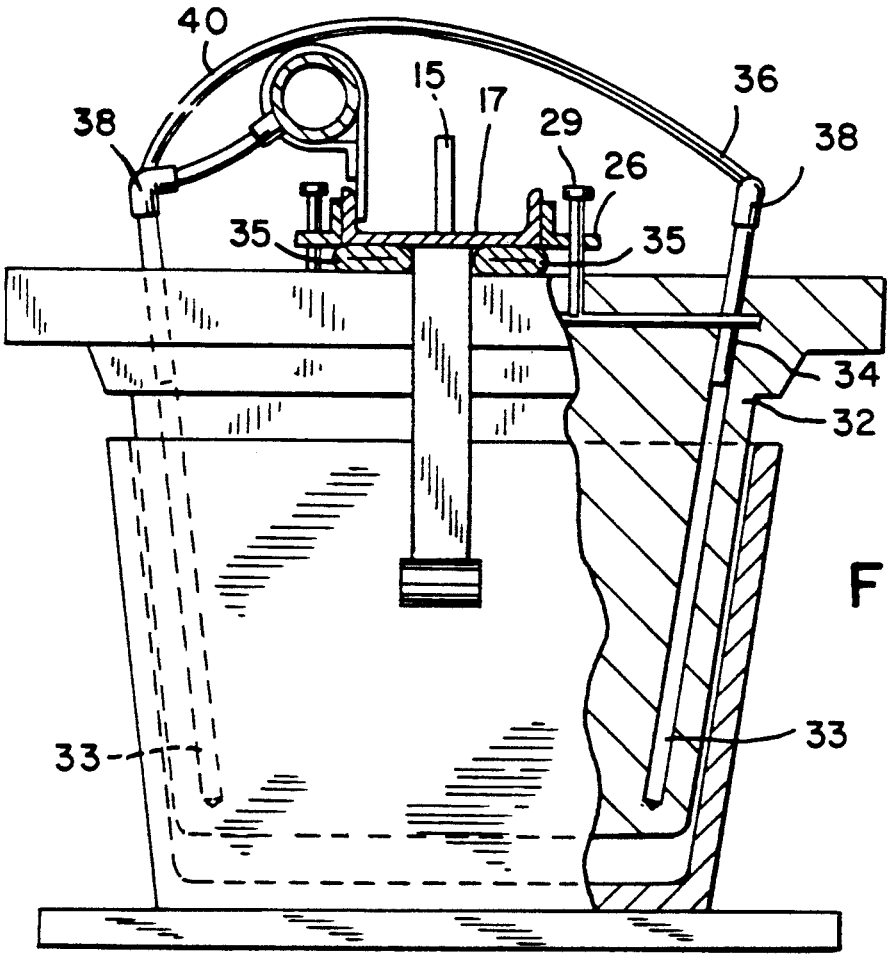
FIG. 5 is a view similar to FIG. 4, but showing the release of the molded part from the mold.

FIGS. 1 and 2 disclose female mold portions 30 and mold male portions 32. As shown in FIG. 1, the male mold portions 32 are connected to the beam 17 by rods 24 which are slidably received in the flanges 26 of beam 17. Suitable openings are provided in the flanges 26 for this purpose, and the enlarged rod heads 29 provide retention. The rods 24 are secured in the male portion 32 by the horizontal portion 31. This is best seen in FIGS. 3 and 4.

Positioned between the male mold portions 32 and the beam 17 are a pair of end to end hoses 35. Placed between the male mold portion 32 and the female mold portion 30 are a pair of end to end hoses 37. As best seen in FIG. 3, the hoses 37 are positioned between the flanges 39 of the male mold portions 32 and the flanges 41 of the female mold portions 30.

As best seen in FIGS. 3–6, each of the male mold portions 32 has four channels 33 at the corners of the mold portions. These channels 33 extend from the top of the mold and terminate a short distance from the bottom. Disposed in each channel 33 is a tube 34 which has a diameter of ¼ inch and extends a short distance into the channels terminating in the flange portion 39. Each of the tubes 34 is interconnected to a supply hose 36 by the appropriate "T" or elbow connectors 38 with the supply hose 36 connected to a 2 inch diameter main supply line 40. Main supply line 40 is secured to beam 17 by the bracket 22 with the pressurized air in the line 40 regulated by a main air supply valve (not shown).

Referring back to FIG. 1, it is seen that there are two end to end benches 25 which support the female mold portions 30 and extend down each of the back to back production lines. These benches also provide a means for supporting the casting intake manifold 27 and the lateral casting lines 28. These provide a path for the casting material to the inside of each female mold portion 30. Also connected to the benches 25 are the clamp plates 45 which provide a connection with the clamp arms 46 connected to the beams 17. Referring again to FIGS. 3 and 4, it is seen that the clamp arm 46 has the eye portion 50 and the clamp plate 45 has the eye portions 51. These provide for alignment and reception of the pin 48 for connecting the clamp plate 45 and the clamp arm 46 together.

Referring specifically to FIGS. 1 and 2, it is seen that there is a latching mechanism (generally 57) which includes a latch hook 58 connected to end beams 17 for engagement with the latch bars 60. The latch bars 60 in this instance are supported by the cross supports 61 and the vertical supports 62 and are pivotally connected to the vertical supports 62 through the shafts 63 which are rotated by the bell cranks 65. The bell cranks 65 are interconnected by the adjustable rods and are rotated by the pull chain 67. This latching mechanism does not form part of the invention but is merely a safety mechanism in the instance where a failure of the cylinders 20 might occur when the male mold portions 32 are in a fully lifted position such as shown in FIG. 2.

METHOD OF OPERATION

A better understanding of the apparatus 10 and its method of usage will be had by a description of its operation. As will be appreciated from FIGS. 1 and 2, the apparatus 10 is capable of multiple or battery-type casting operation with a multiplicity of male 32 and female 30 mold portions positioned in a series as well as in two separate back to back rows. In a preferred manner, eleven pairs of the mold portions are connected in series which means each casting apparatus 10 can cast 22 articles during one operation. Multiples of the apparatus 10 are being used so that 110 articles are produced in one operation. This provides for maximum utilization of time, materials and conservation of space.

The process is started with the male 32 and female 30 mold portions positioned as shown at the left hand side of FIG. 1. In this instance, the female mold portion 30 and the male mold portion 32 are clamped together by the clamp plate 45 and the clamp arm 46 with the pin 48 interconnecting them. In order to effect a complete clamping of these mold parts, the hoses 35 are inflated with a fluid such as air. This forces the mold portions 30 and 32 firmly together between the bench 25 and the beam 17.

The source of air is a common air regulated source and the introduction is indicated by the arrow 43 in FIG. 2. The hose 37 is similarly inflated when desired. All of the hoses are clamped shut at opposing end such as by the hose clamps 44. As indicated above, the mold portions are positioned as shown on the left side of the drawing FIG. 1 and in FIG. 3 with the female mold portion 30 resting on the bench 25. In casting a typical toilet tank, ceramic casting material of the usual type is introduced into the manifold 27. The casting material flows in a regulated manner through the casting line 28 and into the female mold part 30. This can be effected either by a gravity flow tank or by pump pressure using a control valve. The casting in the mold portions is best seen as shown in FIG. 3. Note that the male mold portion 32 is spaced from the female mold portion 30 a predetermined amount and will be filled with the casting material 47.

After a predetermined period of time which is standard for this type of casting, the male mold portion and the female mold portion 32 and 30, respectively, are separated from each other. This is accomplished by deflating the air hoses 35 by opening a release-valve (not shown), releasing the end to end pin 48, and inflating the air hoses 37. This latter inflation effects a movement between the female mold portion 30 and the male mold portion 32 which causes movement of the male mold portion upwardly from the female mold portion 30. After this initial separation, a cylinder 20 will be actuated so as to lift the male mold portion 32 away from the female mold portion 30 with the resulting toilet tank 55 cast on the male mold portion 32. The lifting is to a height so that a suitable end to end support board such as 53 (or multiple support boards) can be placed over the female mold portion 30. This is indicated in FIG. 4 with the male mold portion 32 and the tank 55 positioned a short distance over the board 53.

An important aspect of this invention is the manner by which the casted tank 55 is stripped from the male mold portion 32. It should be appreciated that the casted tank 55 is of a very fragile material and consequently can be easily broken, cracked or warped if it is not carefully removed from the male mold portion 32. This is the purpose of the channels 33 and the tubes 34 placed in the male mold portion 32. Pressurized fluid (e.g. air) is introduced in a regulated manner into the channels 33 by means of the tubes 34 which are interconnected to supply hose 36. As the male mold part 32 is formed from a porous material which in this instance is plaster composed from gypsum, the air will diffuse to the outside of the mold portion 32, thus forcing the tank 55 away from mold portion 32. An added advantage in using pressurized air for this purpose is the fact that the casting material contains water. This water acts as a lubricant between the surface of the mold part 32 and the tank 55 to assist in its release.

Even distribution of the air is effected by the channels being located at the corners of the mold portion 32. A further advantage of this release feature is an inherent nonrelease of the tank 55 if it does not contain the proper amount of moisture for release. If it does not, the air is not capable of releasing the molded part 55. The operator simply waits till it does, and then reintroduces the air through the tubes 34. This procedure avoids any cracking of the tank 55 during release.

After the tank 55 is removed from the male mold portion 32 and deposited on the board 53, the assembly 23 is raised to a clear position such as that shown in the right hand side of FIG. 1. This allows for subsequent work to be easily effected on the newly casted tank 55.

Other fluid means besides pneumatic means could also be utilized to separate the male and female mold parts as well as to clamp the mold parts together. The tubes such as 34 and the channels 33 int eh mold part 32 provide fluid means for releasing the cast molded part 55. While air is the preferred fluid media, water could be utilized (as could other gases or liquids). This also applies to the clamp and release hoses 35 and 3, respectively.

While the method and apparatus of this invention has been shown in conjunction with the casting of a plumbing fixture such as a toilet tank, it could also be employed to automate the cast of any type of molded part. Also while an efficient casting method has been presented in the use of a multiplicity of mold assemblies which are grouped together in a batter-type operation, at least some of the advantages of this invention could be accomplished while employing it in a single mold.

While providing a fluid release mean for releasing a molded part in conjunction with the male mold potion is shown, it is also conceivable that the channels and tubes be placed in conjunction with the female mold portion where the molded part is designed to initially adhere to the female mold portion. In this instance the female mold portion could be inverted or the molded part lifted therefrom after being released by the fluid.

Thus, while certain preferred embodiments have been described above, it should be readily apparent to those skilled that a number of other modifications and changes can be made without departing from the invention. For example, air channels 33 have been preferably disclosed as being at the corners of the mold portion 32. Any number of channels and sizes could be employed depending on the mold size. Further, rather than vertically disposed channels 33, horizontal channels could be employed at various levels although this would be more costly to fabricate in a mold portion. Therefore, it is intended that the scope of the intention should not be limited solely by the description of the preferred embodiments.

I claim:

1. An apparatus for casting and releasing a desired item, comprising:

a female mold portion;

a male mold portion for spaced positioning in said female mold portion along a given axis such that the desired item can be formed therebetween, one of said mold portions being composed of a porous material and having essentially linear and elongated side walls extending along said given axis; and driving means operatively associated with said porous mold portion to force fluid into the porous mold portion and then against said formed desired item to assist in separating said formed desired item from said porous mold portion, said driving means defined in part by a plurality of essentially linear channel members formed integrally in and as a portion of said porous mold portion, said channel members being essentially aligned with said given axis and essentially aligned with and adjacent the side walls as of said porous mold portion with said channel members extending from one end of the mold portion to essentially an opposing end and terminating in said mold portion and not at its lower peripheral surface, said channel members positioned sufficiently adjacent to the side walls to assist in release along the side walls by radial transverse diffusion of the fluid along the length of and from the channel members through the porous mold portion to a side wall of the formed desired item.

2. The apparatus of claim 1, wherein said channel members are disposed in said male mold portion.

3. The apparatus of claim 2, wherein said channel members are connected to tubular members for flowing fluids to said channel members.

4. The apparatus of claim 2, wherein said channel members are connected to a source of air.

5. The apparatus of claim 3, wherein said channel members and said tubular members are disposed at corners of said mold portion.

6. The apparatus of claim 1, including means to lift said male mold portion from said female mold portion.

7. The apparatus of claim 1, wherein said female and male mold portions are constructed and arranged to form a plumbing fixture.

8. The apparatus of claim 1, wherein there are a multiplicity of interconnected female and male mold portions.

9. The apparatus of claim 1, wherein said mold porous portion is composed of plaster.

10. The apparatus of claim 1 wherein the porous mold member is designed so as to permit the fluid from the driving means to first diffuse through a solid part of the porous mold before reaching the formed desired item.

11. The apparatus of claim 1, further including:

a holding means clamping said female and male mold portions together during a portion of the casting of the desired item; and means operatively positioned between said mold portions for separating said mold portions.

12. A male mold member for axial alignment with a female mold member along a given axis for casting a desired item, wherein the desired item can be released from the male mold member, comprising:

a male mold body composed of a porous material, said body having essentially linear and elongated side walls extending along said given axis; and a channel member formed integrally in and as a portion of said body in an essentially linear manner and in an essentially aligned relationship with said given axis and essentially aligned with and adjacent the side walls of said porous mold portion with said channel member extending from one end of the mold to essentially an opposing end an terminating in said mold portion and not at its lower peripheral surface, said channel member adapted to receive a fluid; and a porous wall between the channel member and an outer peripheral male mold surface such that fluid can enter said channel member and then diffuse therefrom through the porous wall to the mold surface, said channel member positioned sufficiently adjacent to one of the side walls to assist in release along the side wall by radial transverse diffusion of the fluid along the length of and from the channel member through the porous wall to a side well of the formed desired item.

13. The mold member of claim 12 further including a tubular member in fluid communication with said channel member.

14. The mold member of claim 12 wherein said male mold body is constructed in conjunction with a female mold portion to provide a mold for a toilet tank.

* * * * *

UNITED STATES PATENT AND TRADEMARK OFFICE

CERTIFICATE OF CORRECTION

PATENT NO. : 5,299,624

DATED : April 5, 1994

INVENTOR(S) : Larry McKinney, Sr.

It is certified that error appears in the above-identified patent and that said Letters Patent is hereby corrected as shown below:

On the title page:

Item [56] - References Cited U.S. Patent Documents
Column 1, line 9 "3,570,068 3/1972" should be --3,570,068 3/1971--.

Column 1, line 3 after "filed" "Aug. 6, 1991" should be --Aug. 6, 1992--.

Column 1, line 68 before "separates" "their" should be --then--.

Column 5, line 18 after "33" "int eh" should be --in the--.

Column 5, line 30 before "operation" "batter-type" should be --battery type--.

UNITED STATES PATENT AND TRADEMARK OFFICE

CERTIFICATE OF CORRECTION

PATENT NO. : 5,299,624

DATED : April 5, 1994

INVENTOR(S) : Larry McKinney, Sr.

It is certified that error appears in the above-indentified patent and that said Letters Patent is hereby corrected as shown below:

Column 5, line 33, after "release" "mean" should be --means --.

Column 5, line 34, after "mold" "potion" should be --portion --.

Column 6, line 62, claim 12, after "end" "an" should be --and --.

Signed and Sealed this

Sixth Day of September, 1994

*Attest:*

*Attesting Officer*

BRUCE LEHMAN

*Commissioner of Patents and Trademarks*